US005573381A

United States Patent [19]

Pane et al.

[11] Patent Number: 5,573,381

[45] Date of Patent: Nov. 12, 1996

[54] INTERNALLY REGULATED SELF PRIMING FUEL PUMP ASSEMBLY

[75] Inventors: Michael F. Pane, Lake Ariel, Pa.; James J. Grinsteiner, Union; Martin R. Zielke, Lockport, both of Ill.

[73] Assignee: Navistar International Transportation Corp., Chicago, Ill.

[21] Appl. No.: 492,505

[22] Filed: Jun. 20, 1995

[51] Int. Cl.[6] ..... F04B 49/00

[52] U.S. Cl. ..... 417/284; 417/285; 417/307

[58] Field of Search ..... 417/283, 284, 417/285, 307

[56] References Cited

U.S. PATENT DOCUMENTS

| | | | |
|---|---|---|---|
| 1,878,326 | 9/1932 | Ricardo | 417/285 |
| 2,985,112 | 5/1961 | Henry | 417/284 |
| 3,049,284 | 8/1962 | Alamprese | 417/284 |

*Primary Examiner*—Richard E. Gluck
*Attorney, Agent, or Firm*—Dennis K. Sullivan

[57] ABSTRACT

A dual-piston fuel pump assembly includes a housing having an inlet to a primary chamber and an outlet from a pumping chamber. Between the primary and pumping chambers are interposed concentric inner and outer pistons. Each piston is independently spring biased toward the pumping chamber. The inner piston is mechanically driven by an engine associated reciprocating drive and pumping action occurs as a result of the spring operating on the inner piston. The position of the outer piston relative to the inner piston is determined by the pressure in the pumping chamber as regulated by the force of the spring operating against the outer piston. When pressure in the pumping chamber exceeds predefined limits, the outer piston opens regulator ports disposed on the inner piston to recirculate fuel back into the low pressure primary chamber. Additionally, the outer piston acts as an accumulator to dampen pressure spikes.

9 Claims, 2 Drawing Sheets

INTERNALLY REGULATED SELF PRIMING FUEL PUMP ASSEMBLY

BACKGROUND OF THE INVENTION

The present invention relates to a fuel supply pump assembly for a fuel injected internal combustion engine, especially a diesel engine, and, more particularly, to a dual-piston, self-priming fuel pump wherein an outer regulating piston is concentrically disposed about an inner pumping piston to maintain fuel pressure within desired limits at all engine speeds and damping potential pressure spikes, the regulating piston further coacting with the inner piston to pump air in the self-priming mode.

THE PRIOR ART

Heretofore, various fuel pump assemblies for use in fuel injected systems have been used to supply fuel to a fuel injection pump or to a common fuel rail supplying a plurality of unit injectors.

One pump assembly in use with a common rail system for supplying hydraulically-operated, electronically controlled unit injectors combines a piston pump in tandem with a diaphragm pump, as disclosed in U.S. Pat. No. 5,190,444 but requires an external regulator for limiting maximum pressure. Additionally, since the pump assembly capacity is sized to deliver at least as much fuel as required for full load operation, an excess amount of fuel will be supplied under certain conditions, for example, under high speed and light load conditions, which must be returned to the fuel tank through the common rail which is incorporated in the cylinder head, as shown, for example, in U.S. Pat. No. 5,245,970. The fuel is thus heated in the cylinder head on its way back to the tank, causing tank temperature to rise. Further, the pump assembly cannot accommodate damping of high pressure spikes between the pump and the external regulator.

SUMMARY OF THE INVENTION

Accordingly, it is a primary object of the invention to provide a dual-piston fuel pump assembly having the capability to internally regulate the pumping pressure and to dampen high pressure spikes.

Further, it is an object to provide a pump assembly capable of delivering fuel appropriately at all engine speeds while internally recirculating excess fuel, thereby limiting recirculation through the common rail.

Still further, it is an object to provide a pump assembly which is self-priming as well.

These and other objects are specifically met by a dual-piston, self-priming fuel pump assembly, preferably actuated by a tappet, which includes two relatively slidable concentric pistons, each controlled by its own return spring, wherein, in the normal pumping mode, the inner piston pumps the fuel while the outer piston moves under control of its spring to adjust the size of the pumping chamber, thereby regulating the pumping pressure and acting as an accumulator to dampen pressure spikes. Should excessive pressure be encountered, recirculation ports in the inner piston become exposed to recirculate fuel from the pumping chamber back to the inlet portion of the pump housing. The pumping springs are so configured that should air be present in the inlet side of the housing, and thus no appreciable pressure, both pistons will move together and thus increase the pumping capacity to more quickly purge the air and prime the system, such activity continuing until sufficient fuel pressure exists to cause the outer piston to begin its regulating motion relative to the inner piston. Thus, the pistons first coact to purge air from an empty fuel system and then maintain regulated internal pressure to accommodate all engine speeds without creation of pressure spikes.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
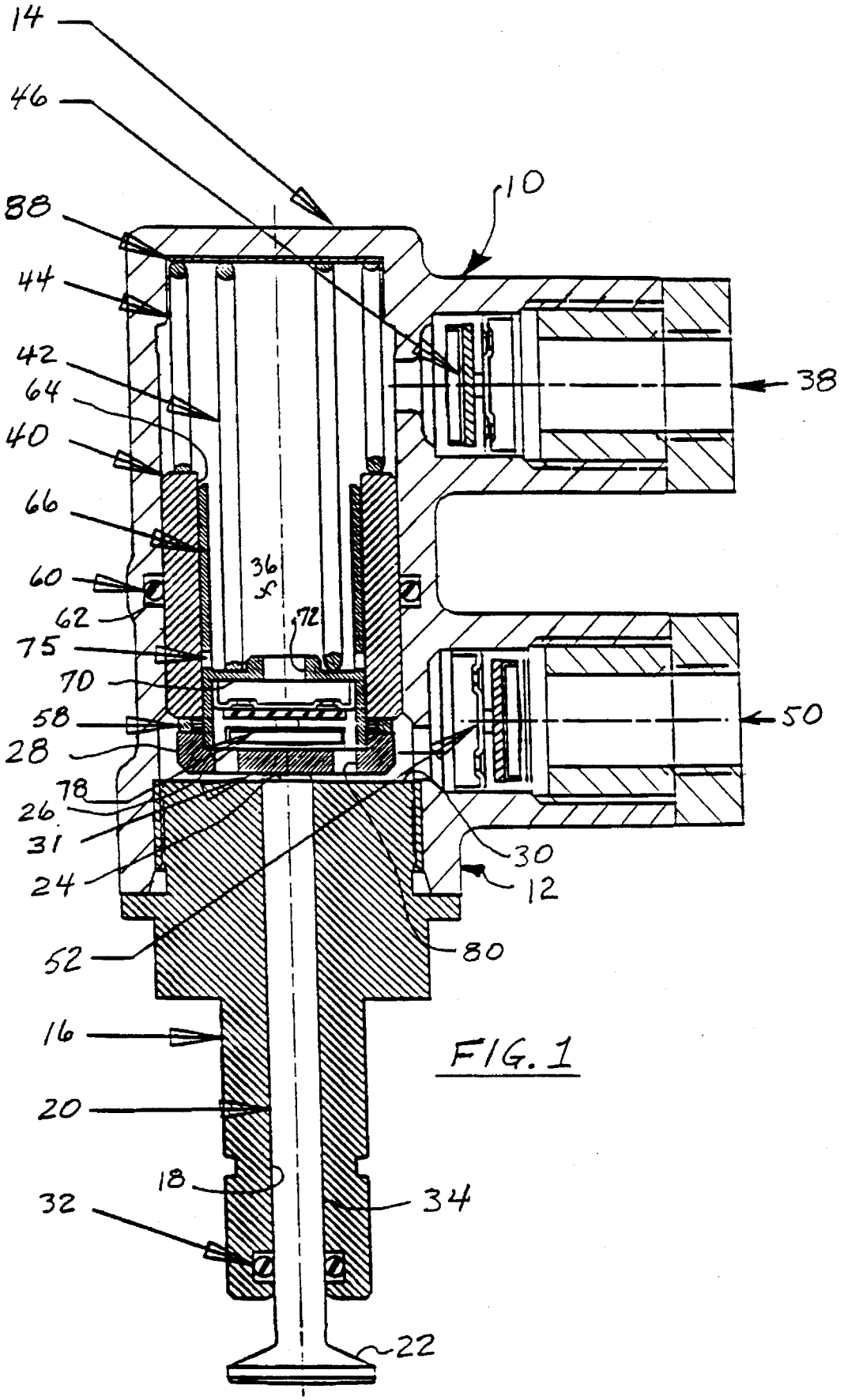
FIG. 1 is a cross-section through the dual-piston fuel pump assembly of the present invention, showing both pistons at the bottom of a stroke, when no fuel is present in the pump housing.

Referring now to the drawings,in greater detail, there is illustrated therein a dual-piston, self-priming fuel pump assembly made in accordance with the teachings of the present invention and generally identified by the reference numeral 10.

As shown, a body 12 of the assembly 10 includes two housing portions, an upper piston housing 14 and a lower tappet housing 16. The tappet housing 16 includes a center bore 18 therein within which a tappet 20 is slidingly engaged, a lower end 22 of the tappet being flared to provide a larger contact area on the surface of the camshaft (not shown). Further, an upper end 24 of the tappet 20 is configured to engage against a lower surface or head 26 of a first inner piston 28 disposed within the piston housing 14, the upper end 24 of the tappet 20 maintaining the piston 28 at all times slightly elevated above an upper surface 30 of the tappet housing 16 to form a pumping chamber 31 therebetween.

Inasmuch as the tappet 20 is exposed to fuel under high pressure, an O-ring 32 is disposed within the housing 16, surrounding a stem portion 34 of the tappet 20 to keep such high pressure fuel from leaking therearound via the bore 18.

Seated over and engaged to an upper portion of the tappet housing 16 is the piston housing 14. The piston housing 14 includes a primary chamber 36 therein which communicates with a fuel inlet 38 into the assembly 10. A second outer piston 40 having a central bore 64 is slidingly disposed in the primary chamber 36 of the piston housing 14 and the first inner piston 28 is slidingly disposed within the central bore 64 of the outer piston. The inner and outer pistons 28, 40 are separately biased to move in the direction of the tappet housing 16 by respective cylindrical helical coil compression springs which abut against the upper side 88 of the primary chamber 36, a pumping spring 42 for the inner piston 28 and a regulator spring 44 for the outer piston 40.

The pumping spring 42 must have a high spring rate than the regulator spring 44.

The inlet 38 has a one way check valve assembly 46 seated therein, the check valve assembly 46 preventing reverse flow from the primary chamber through the inlet 38. The piston housing 14 also has an outlet 50 therefrom extending from the pumping chamber 31, the outlet 50 also including a one way check valve assembly 52 therein preventing reverse flow from the outlet 50 to the pumping chamber 31.

Figure 3:
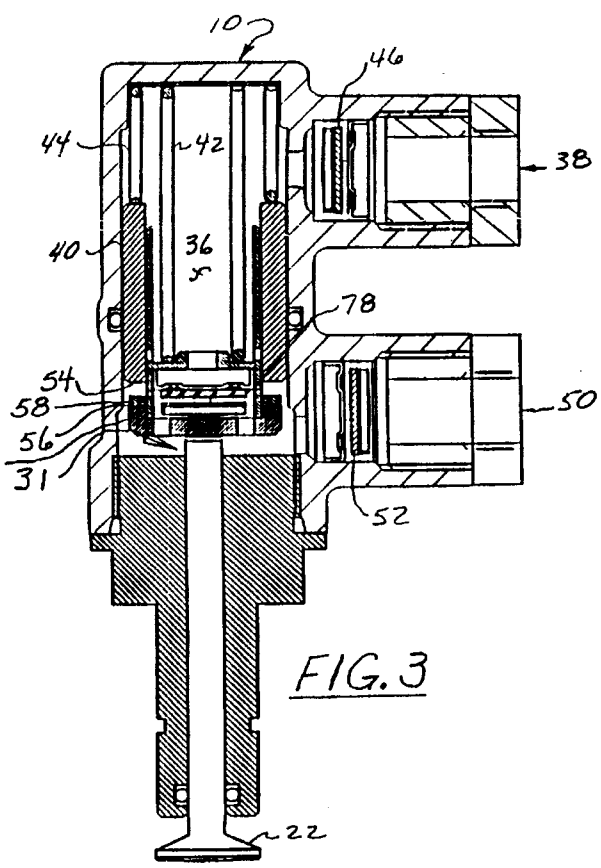
FIG. 3 is a view similar to FIG. 2 but showing both pistons in mid-stroke, moving downwardly, with the inner piston delivering high pressure fuel, the pressure being regulated by action of the outer piston.

As shown in FIG. 3, the cylindrical outer piston 40 has a bottom surface 54 which rests against a radially extending peripheral flange 56 of the first inner piston 28 through a peripheral face seal 58 disposed on the flange 56 therebetween.

Returning to FIG. 1, an O-ring 60 is seated within a groove 62 in the piston housing 14 in a vertical position assuring constant contact against the piston 40 during reciprocal travel of the piston 40 within the piston housing 14, thereby preventing leakage around the outer piston 40.

As discussed above, the outer piston 40 has a central bore 64 which receives the inner piston 28, the latter having a cylindrical upstanding peripheral wall portion 66 of a length sufficient to maintain contact at all times with the outer piston 40. Seated within and across part of the chamber 36 defined by this wall 66 is a radial flange 70 which acts as a seat 36 for the pumping spring 42 of the inner piston 28, the flange 70 incorporating a center bore 72 therein through which fuel in the primary chamber 36 defined thereabove can enter into the pumping chamber 31. Within the inner piston 28 but beneath the flange 70, a third one way check valve assembly 78 is disposed to prevent reverse flow from the pumping chamber 31 to the primary chamber 36. A plurality of apertures 80 are provided in the lower surface 26 of the inner piston 28 to permit fuel to enter the pumping chamber 31.

Figure 4:
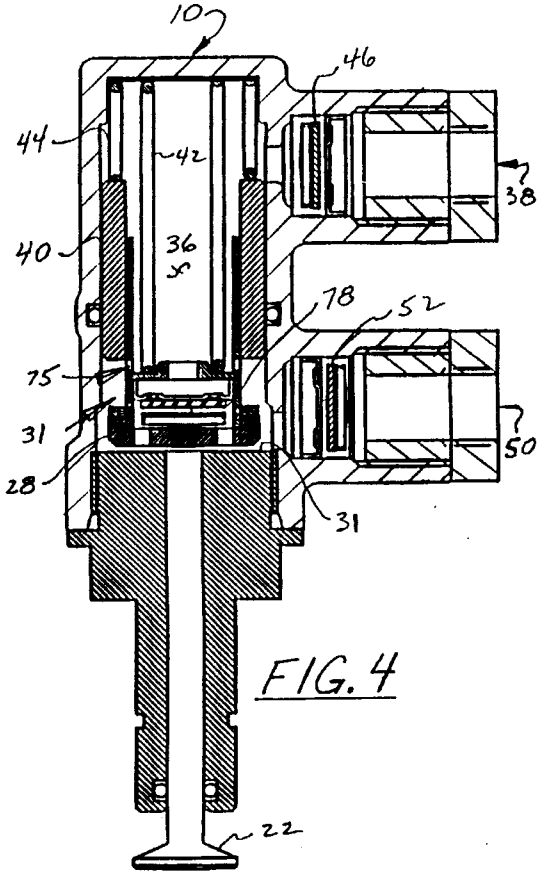
FIG. 4 is similar to FIG. 3 but showing the inner piston at the bottom of a stroke while the outer piston is shown acting to limit maximum output pressure by permitting fuel recirculation back to the inlet.

Within the peripheral wall 66 of the inner piston 28, at a position proximate to the flange 70 are provided a plurality of regulator ports 75 which, when the pistons 28 and 40 are at opposite extremes of travel, form a path between the pumping chamber 31 and the primary chamber 36 as shown in FIG. 4.

Figure 2:
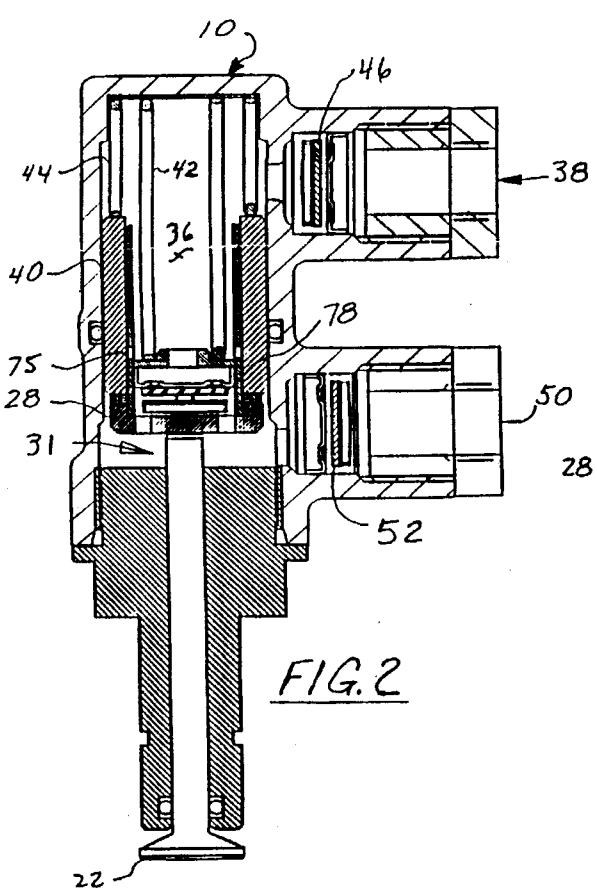
FIG. 2 is a view similar to FIG. 1 but showing both pistons at the top of a stroke, ready to begin purging air from the assembly.

In operation, at the beginning of a pumping stroke with the system dry, as shown in FIG. 1, the tappet 20 moves upwardly to the position shown in FIG. 2 periodically as driven by a conventional eccentric on the engine camshaft (not shown) driving both the inner and outer pistons upwardly. During the upward motion, air in the primary chamber 36, being constrained by the inlet check valve 46, escapes past the check valve 78 in the inner piston 28 into the pumping chamber 31. As the tappet 22 retracts to the position shown in FIG. 1, the pumping and regulator springs 42 and 44 force the pistons downwardly, thereby pumping the air in the pumping chamber past the outlet check valve 52 and out of the pump outlet 50 and self priming the pump 10. At this point, there is substantially no pressure in the pumping chamber 31.

As the air in purged and fuel begins to be pump, fuel pressure in the pumping chamber 31 increases and acts against the bottom surface 54 of the outer piston 40, causing the outer piston 40 to rise in the primary chamber 36, and relative to the inner piston 28, against the force of the regulator spring 44. Thus, the action of the outer piston 40 against its spring 44 provides an internal pressure regulating function for the pump, the regulated pressure being determined solely by the rate of the regulator spring 44. Since the upward movement of the outer piston 40 relative to the inner piston 28 increases the volume of the pumping chamber 31, the outer piston 40 together with the space therebeneath between the inner piston 28 and the inner wall of the pump housing 14 also functions as an accumulator to dampen pressure spikes which may occur in the pumping chamber.

Should there be excess capacity in the fuel pump assembly for the required engine operation, for example, if the associated engine were running at a high idle speed with a light load on the engine, the pressure in the pumping chamber 31 would continue to build up thereby forcing the outer piston 40 even higher relative to the inner piston until the ports 75 in the wall 66 of the inner piston 28 are exposed. Since the pressure in the primary chamber 36 is quite low relative to the pumping chamber, a portion of the fuel in the pumping chamber 31 is then recirculated through the ports 75 back into the primary chamber 36 while less makeup fuel is drawn into the primary chamber through the inlet valve 46. Such recirculation continues until the pressure in the pumping chamber 31 decreases sufficiently to allow the outer piston 40 to lower, partially or completely closing the regulator ports 75 as required and stabilizing pressure in the pumping chamber 31.

The recirculation of the fuel within the pump, as discussed above, ultimately reduces the amount of fuel which is recirculated through the common rail back to the fuel tank and, ultimately, back to the pump inlet. Additionally, in a common rail fuel system which is incorporated in the cylinder head or is otherwise exposed to the heat of the engine, less heated fuel will be returned to the fuel tank and thus the temperature of the fuel in the tank will remain at a lower level.

An important advantage of the internal regulating and recirculating system incorporated in the pump assembly of the invention is that the pumping losses which would normally result from pumping the excess fuel all the way through the common rail and back to the fuel tank, and eventually, back to the pump, are eliminated. Thus, the parasitic load on the engine is reduced and more usable power is available.

As described above, the dual-piston, self-priming pump assembly of the present invention offers a number of advantages, some of which have been described above and others of which are inherent in the invention. It will be evident to those of ordinary skill in the art that various alterations and modifications can be made to the system without departing from the teachings herein. Accordingly, the scope of the invention is only to be limited as necessitated by the accompanying claims.

What is claimed is:

1. A fuel pump assembly comprising:

a housing having an internal cavity including a primary chamber for receiving fuel through an inlet thereto and a pumping chamber having an outlet therefrom;

a cylindrical outer piston slidably disposed in said housing between said primary chamber and said pumping chamber, said outer piston having a central bore;

a regulator spring disposed in said primary chamber between said housing and said outer piston to bias said outer piston toward said pumping chamber;

an inner piston slidably disposed between said primary chamber an said pumping chamber and within said central bore of said outer piston;

a check valve disposed in said inner piston, said check valve permitting flow only from said primary chamber to said pumping chamber;

a pumping spring disposed in said primary chamber between said housing and said inner piston to bias said inner piston toward said pumping chamber;

reciprocating drive means for moving said inner piston toward said primary chamber and allowing said pumping spring to bias said inner piston toward said pumping chamber.

2. The invention in accordance with claim 1 and a fluid recirculation passage disposed between said pumping chamber and primary chamber, said recirculation passage being opened and closed by said outer piston in response to fuel pressure in said pumping chamber.

3. The invention in accordance with claim 2 and said recirculation passage comprising a pressure regulating port disposed in a wall of said inner piston which, upon pressure in the pumping chamber rising above a predefined limit, is opened by relative motion between the pistons.

4. The invention in accordance with claim 3 and a check valve disposed in said housing inlet and preventing flow from said primary chamber through said inlet.

5. The invention in accordance with claim 1 and said inner piston including a head portion engaged by said drive means and a cylindrical wall portion extending from the head portion and seating against an inner wall surface of the outer cylindrical piston.

6. The invention in accordance with claim 5 and said head portion of said inner piston including a peripheral flange against which a lower end of the outer piston seats.

7. The invention in accordance with claim 6 and said inner piston includes a chamber at the head end thereof and defined by said cylindrical wall portion, said head portion and a radial flange disposed within said cylindrical wall portion, an inlet to said chamber disposed in said radial flange, and an outlet disposed in the wall engaging the drive means, said check valve being disposed in said chamber.

8. The invention in accordance with claim 7 and said cylindrical wall portion having a plurality of ports therethrough disposed above said radial flange.

9. A fuel supply pump for an internal combustion engine comprising:

a drive housing having an axial bore adapted for mounting to said engine;

a mechanical actuator mounted for reciprocating movement in said drive housing bore and having a first end adapted for operative engagement by said engine;

a pump housing mounted to said drive housing and defining a cylindrical internal cavity axially aligned with said drive housing bore, said cavity having a first portion defining a primary chamber and a second portion adjacent said drive housing defining a pumping chamber, said pump housing further having an inlet to said primary chamber, said inlet have an inlet check valve therein, and an outlet from said pumping chamber, said outlet having an outlet check therein;

a first piston slidably mounted in said internal cavity and biased toward said drive housing by a regulator spring, said first piston having a central bore; and a second piston having a cylindrical side wall slidably mounted within said central bore of said first piston for sliding movement relative thereto, said second piston having a head end abutting said actuator and being biassed thereagainst by a pumping spring, said second piston including a passage extending therethrough and a check valve mounted in said second piston and disposed in said passage to divide said internal cavity between said primary chamber and said pumping chamber, said second piston further including a regulating port extending through said cylindrical side wall into said primary chamber, said first piston having a range of motion relative to said second piston extending between a first position closing said port and a second position establishing a fuel recirculation passage from said pumping chamber through said port to said primary chamber.

* * * * *